United States Patent [19]

Yoshimoto et al.

[11] Patent Number: 5,019,331

[45] Date of Patent: May 28, 1991

[54] HEAT-RESISTANT ALLOY

[75] Inventors: Teruo Yoshimoto, Suita; Makoto Takahashi, Hirakata, both of Japan

[73] Assignee: Kubota Corporation, Osaka, Japan

[21] Appl. No.: 503,575

[22] Filed: Apr. 3, 1990

[30] Foreign Application Priority Data

Apr. 5, 1989 [JP] Japan ..... 1-86562

[51] Int. Cl.[5] ..... C22C 38/48; C22C 19/05

[52] U.S. Cl. ..... 420/51; 420/54; 420/55; 420/62; 420/103; 420/447; 420/449; 420/584.1

[58] Field of Search ..... 420/51, 54, 55, 62, 420/103, 447, 449, 584.1

[56] References Cited

U.S. PATENT DOCUMENTS 2,553,330 5/1951 Post et al. ..... 420/584

2,955,934 10/1960 Emery ..... 420/584

4,448,749 5/1984 Sugitani et al. ..... 420/584

*Primary Examiner*—R. Dean

*Assistant Examiner*—Robert R. Koehler

*Attorney, Agent, or Firm*—Armstrong, Nikaido, Marmelstein, Kubovcik & Murray

[57] ABSTRACT

A heat-resistant alloy comprising, in % by weight, 0.3–0.8% of C, 0.5–3% of Si, over 0% to not greater than 2% of Mn, at least 23% to less than 30% of Cr, 40–55% of Ni, 0.2–1.8% of Nb, over 0.08% to not greater than 0.2% of N, 0.01–0.5% of Ti and/or 0.01–0.5% of Zr, and the balance Fe and inevitable impurities. The alloy is usable at high temperatures exceeding 1100° C. with high creep rupture strength and excellent resistance to oxidation and to carburization, further exhibiting high creep deformation resistance at high temperatures and high ductility after aging.

2 Claims, 3 Drawing Sheets

HEAT-RESISTANT ALLOY

FIELD OF INDUSTRIAL APPLICATION

The present invention relates to alloys useful as materials for cracking tubes for producing ethylene, reformer tubes, etc. for use in the petrochemical industry, and more particularly to heat-resistant alloys having high creep rupture strength, excellent resistance to oxidation and to carburization, high resistance to creep deformation at high temperatures and high ductility.

BACKGROUND OF THE INVENTION

Ethylene is produced by feeding the naphtha and steam into a cracking tube and heating the tube from outside to a high temperature in excess of 1000° C. to crack the naphtha inside the tube with the radiation heat. Accordingly, the material for the tube must be excellent in resistance to oxidation and in strength at high temperatures (especially creep rupture strength and creep deformation resistance).

The process for cracking the naphtha forms free carbon, which becomes deposited on the inner surface of the tube. If carbon is deposited which is small in thermal conductivity, the tube needs to be heated from outside to a higher temperature to cause the cracking reaction, hence a lower thermal efficiency. The tube material must therefore be highly resistant to carburization.

Improved HP material (0.45 C-25 Cr-35 Ni-Nb,W, Mo-Fe) according to ASTM standards has been in wide use as a material for cracking tubes for producing ethylene. With an increase in operating temperature in recent years, however, this material encounters the problem of becoming impaired greatly in oxidation resistance, creep rupture strength and carburization resistance if used at temperatures exceeding 1100° C.

Accordingly, the present applicant has already developed a material capable of withstanding operations at high temperatures above 1100° C. (Examined Japanese Patent Publication No. SHO 63-4897). This material comprises, in % by weight, 0.3–0.5% of C, up to 2% of Si, up to 2% of Mn, 30–40% of Cr, 40–50% Ni, 0.02–0.6% of Al, up to 0.08% of N, 0.3–1.8% of Nb and/or 0.5–6.0% of W, 0.02–0.5% of Ti and/or 0.02–0.5% of Zr, and the balance substantially Fe.

Although this material is usable for operations at high temperatures over 1100° C. with sufficient oxidation resistance, high creep rupture strength and excellent carburization resistance, it has been found that the material undergoes creep deformation relatively rapidly at high temperatures and still remains to be improved in weldability.

If the creep deformation resistance is small at high temperatures, permitting deformation to proceed at a high rate, the guide supporting the cracking tube comes into bearing contact with the furnace floor to induce the bending of the tube. When deformed by bending, the tube is locally brought closer to the heating burner, and the local tube portion is heated to an abnormally high temperature, which results in deterioration of the material and accelerated carburization. To diminish such deformation, the secondary creep rate must be low.

With cracking tubes, it is required to remove the portion deteriorated by carburization, bulging or the like for replacement and repair by welding. Nevertheless, if the material is not satisfactorily weldable, it is substantially impossible to locally repair the tube, giving rise to a need to replace the faulty tube by a new one to entail a very great economical loss. Improved weldability can be imparted to the material by enhancing the ductility thereof after aging.

We have conducted intensive research and found that in the case of the above-mentioned alloy material, Cr incorporated therein to assure oxidation resistance and strength at high temperature is present in an excessive amount and therefore upsets the quantitative balance between Cr and Ti or Zr which is incorporated in the alloy to retard the growth and coarsening of Cr carbide formed in the austenitic phase and to thereby afford improved creep rupture strength, consequently diminishing the creep deformation resistance.

Accordingly, we decreased the Cr content to thereby optimize the quantitative balance between Cr and Ti and/or Zr, retard the progress of secondary creep and improve the ductility after aging.

We have also found that Nb-Ti carbonitride contributes a great deal to the improvement in creep rupture strength. Nitrogen is therefore made present in an increased amount to form the Nb-Ti carbonitride to ensure high creep rupture strength.

SUMMARY OF THE INVENTION

An object of the present invention is to provide a heat-resistant alloy which is usable at high temperatures exceeding 1100° C. with high creep rupture strength and excellent resistance to oxidation and to carburization and which exhibits high creep deformation resistance at high temperatures and high ductility after aging.

Another object of the present invention is to provide a cracking tube which is usable at high operating temperatures in excess of 1100° C. with high creep rupture strength and excellent resistance to oxidation and to carburization and which exhibits high creep deformation resistance at high temperatures and high ductility after aging.

The heat-resistant alloy of the present invention comprises, in % by weight, 0.3–0.8% of C, 0.5–3% of Si, over 0% to not greater than 2% of Mn, at least 23% to less than 30% of Cr, 40–55% of Ni, 0.2–1.8% of Nb, over 0.08% to not greater than 0.2% of N, 0.01–0.5% of Ti and/or 0.01–0.5% of Zr, and the balance Fe and inevitable impurities.

At least 0.5% of Co can be present in the heat-resistant alloy of the present invention, such that the combined amount of Co and Ni is within the range of 40 to 55%.

Further when required, at least one component can be present in the alloy of the present invention, the component being selected from the group consisting of 0.02–0.6% of Al, 0.001–0.5% of Ca, up to 0.05% of B, up to 0.5% of Y and up to 0.5% of Hf.

DETAILED DESCRIPTION OF THE INVENTION

Figure 1:
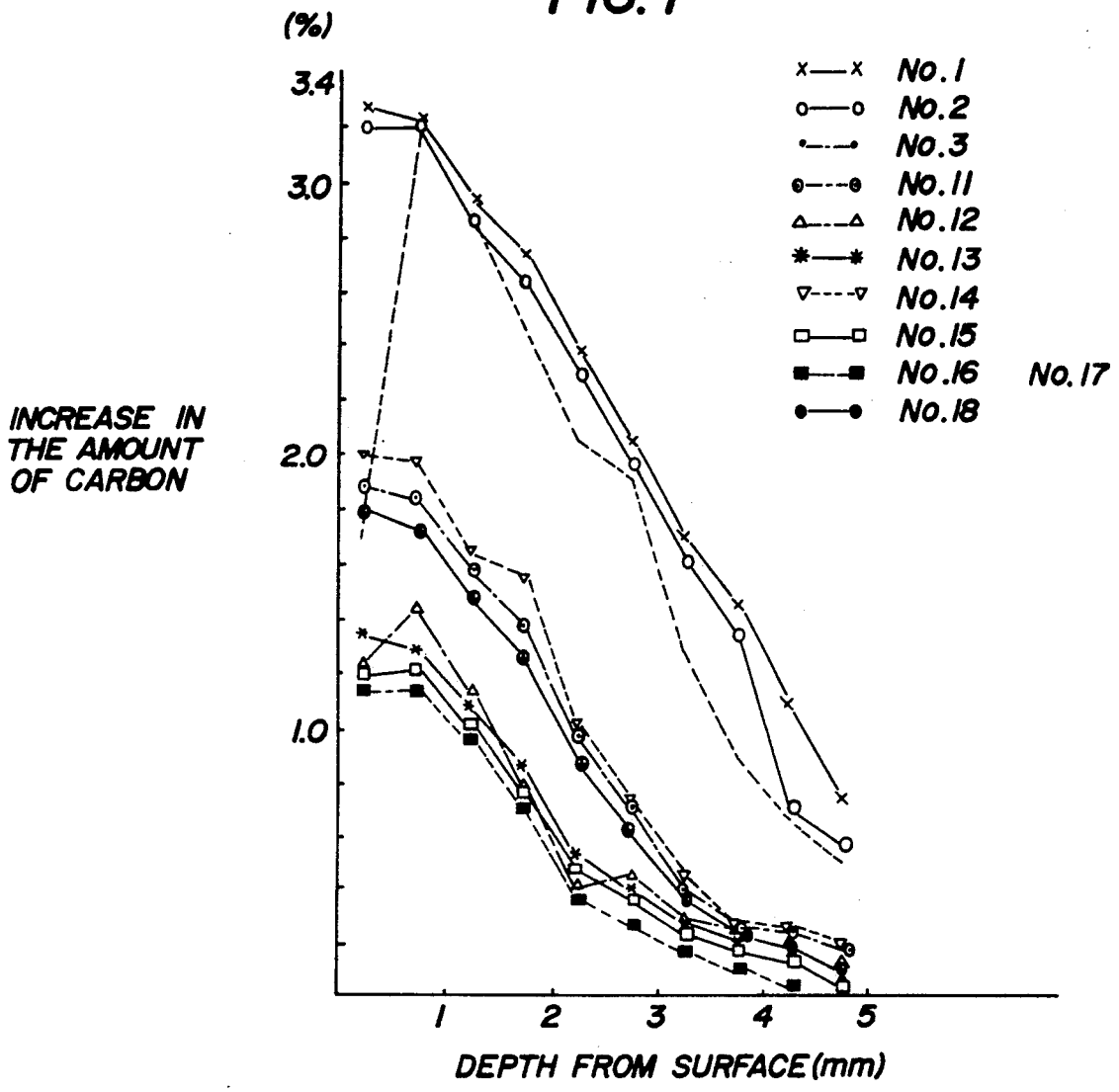
FIG. 1 is a graph showing increases in the amount of carbon as determined by a carburization test.

The heat-resistant alloy embodying the present invention has the foregoing composition, which was determined for the following reasons.

C: 0.3%–0.8%

When the alloy solidifies on casting, C forms Cr, Nb, Ti and like carbides at grain boundaries. C further forms a solid solution in austenitic phase and forms the secondary carbide of Cr in the austenite after the alloy is heated again. The carbide thus formed affords improved creep rupture strength. The higher the C content, the more improved is the weldability of the alloy. Accordingly, it is desirable that at least 0.3% of C be present. On the other hand, if the C content exceeds 0.8%, Cr carbide diffusedly precipitates after use, and the alloy exhibits lower ductility after aging and impaired weldability. For these reasons, 0.3% to 0.8% of C should be present.

Si: 0.5%–3%

When the components are melted into the alloy, Si acts to effect deoxidation and is effective for giving improved fluidity to the molten alloy. With an increase in the amount of Si, a film of $SiO_2$ is formed in the vicinity of the tube inside to inhibit penetration of C. Accordingly, at least 0.5% of Si needs to be present. However, when the Si content exceeds 3%, lower creep rupture strength and impaired weldability will result, hence an upper limit of 3%.

Mn: over 0% to not greater than 2%

Mn acts as a deoxidizer like Si, fixes sulfur (S) during the preparation of alloy in molten state and affords improved weldability. However, even if more than 2% of Mn is present, a correspondingly enhanced effect will not be available, so that the upper limit is 2%. CR: at least 23% to less than 30%

Cr is an element indispensable for the maintenance of oxidation resistance and high-temperature strength. For the alloy to retain the desired creep rupture strength for use at temperatures over 1100° C., at least 23% of Cr must be present. On the other hand, with more than 30% of Cr present, Cr carbide dispersed through austenite causes accelerated secondary creep and lowers the ductility after aging. According to the present invention, therefore, the upper limit of the Cr content is less than 30% to give improved creep resistance, i.e., to retard the progress of secondary creep and improve the ductility after aging.

Ni: 40%–55%

Ni forms the austenitic phase along with Cr and Fe, contributes to the improvement in oxidation resistance, and imparts stability to the Cr carbide after a long period of use (spheroidization of primary carbide, inhibition of growth of secondary carbide). Ni further contributes to the stability of the oxide film near the tube surface, affording improved carburization resistance. For use at temperatures over 1100° C., the alloy needs to contain at least 40% of Ni, whereas presence of more than 55% of Ni does not produce a corresponding increased effect, hence an upper limit of 55%.

With the heat-resistant alloy of the present invention, Ni can be partly replaced by at least 0.5% of Co when required since Co, like Ni, contributes to the stabilization of the austenitic phase and to the improvement in the oxidation resistance and high-temperature strength. However, the Co content should be so limited that the combined amount of Co and Ni is 40 to 50%.

Nb: 0.2%–1.8%

Nb forms Nb carbide and Nb-Ti carbonitride at grain boundaries when the alloy solidifies on casting. The presence of these compounds gives enhanced resistance to progress of cracks at grain boundaries and increased creep rupture strength at high temperatures. Accordingly, presence of at least 0.2% of Nb is desirable. Nevertheless, Nb contents exceeding 1.8% lead to lower oxidation resistance, so that the upper limit should be 1.8%.

N: over 0.08% to not greater than 0.2%

N forms carbonitride, nitride, etc. along with C, Nb and Ti and is effective for giving enhanced creep rupture strength. The alloy of the present invention is therefore made to contain more than 0.08% of N. However, presence of an excess of N causes hardening and results in reduced tensile elongation at room temperature. Accordingly the upper limit should be 0.2%.

Ti: 0.01%–0.5%

When the alloy is used in the form of a cracking tube, Ti retards the growth and coarsening of Cr carbide formed in the austenitic phase by reheating, giving improved creep rupture strength, so that the alloy needs to contain at least 0.01% of Ti. However, the presence of more than 0.5% of Ti does not produce a correspondingly enhanced effect, hence an upper limit of 0.5%.

Zr: 0.01%–0.5%

Zr contributes to the improvement in creep rupture strength like Ti and must be present in an amount of at least 0.01%. Nevertheless, presence of more than 0.5% does not result in a corresponding effect. The upper limit is therefore 0.5%.

Since Ti is equivalent to Zr in the effect to be produced, the objects of the present invention can be fulfilled if either of them is present. However, no trouble occurs if both of them are present at the same time.

The heat-resistant alloy of the present invention comprises the component elements given above, and the balance Fe and impurity elements which become inevitably incorporated into the alloy.

When required, at least one of the component elements given below can be incorporated into the heat-resistant alloy of the present invention.

Al: 0.02%–0.6%

Like Si, Al forms an $Al_2O_3$ film near the tube surface and is effective for inhibiting penetration of C, so that at least 0.02% of Al is used. However, when containing more than 0.6% of Al, the alloy exhibits lower ductility, hence an upper limit of 0.6%.

Further with the heat-resistant alloy of the invention, the foregoing elements can partly be replaced by at least one of the following component elements when so required.

Ca: 0.001%–0.5%

When the alloy is heated to a high temperature, Ca forms an oxide on the surface of the alloy, acting to inhibit diffusion of C into the metal to give improved carburization resistance. Accordingly, at least 0.001% of Ca is used, whereas presence of an excess of Ca impairs other characteristics of the alloy, such as weldability, so that the upper limit should be 0.5%.

B: up to 0.05%

B adds to the strength of grain boundaries, contributing to the improvement in creep rupture strength. Nevertheless, presence of an excess of B impairs weldability and other characteristics of the alloy, hence an upper limit of 0.05%

Y: up to 0.5%

Y affords improved carburization resistance. To ensure this effect, Y can be present in an amount of up to 0.5%.

Hf: up to 0.5%

Like Y, Hf gives improved carburization resistance. To ensure this effect, Hf can be present in an amount of up to 0.5%.

Next, the outstanding characteristics of the alloy of the present invention will be clarified with reference to the following example.

EXAMPLE

Alloys were prepared from various components using a high-frequency melting furnace and made into hollow mold by centrifugal casting. Table 1 shows the chemical compositions of the alloy samples thus obtained.

Test pieces (15 mm in thickness, 25 mm in width and 70 mm in length) were prepared from the alloy samples. Samples No. 1 to No. 3 and No. 11 to No. 18 were subjected to a carburization test, samples No. 1, No. 2 and No. 11 to No. 13 to a creep rupture test, samples No. 1, No. 2, No. 4, No. 5, No. 11 and No. 12 to a creep test, and samples No. 4, No. 5, No. 11 and No. 13 to a tensile test at room temperature after aging.

Figure 2:
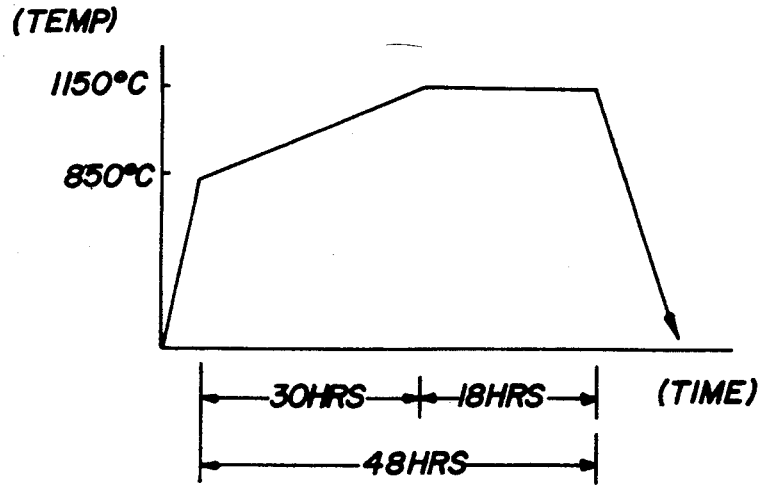
FIG. 2 is a diagram illustrating the conditions for a carburization test.

The carburization test was conducted according to the solid carburization testing method under the conditions shown in FIG. 2. In this test, the test piece was subjected to a carburization treatment under the conditions shown in FIG. 2 repeatedly 17 times (48 hrs.×17 times=816 hrs.), and chips were collected from the surface of the test piece at a pitch of 0.5 mm and chemically analyzed to determine the increase in the amount of carbon. FIG. 1 shows the results.

Figure 3:
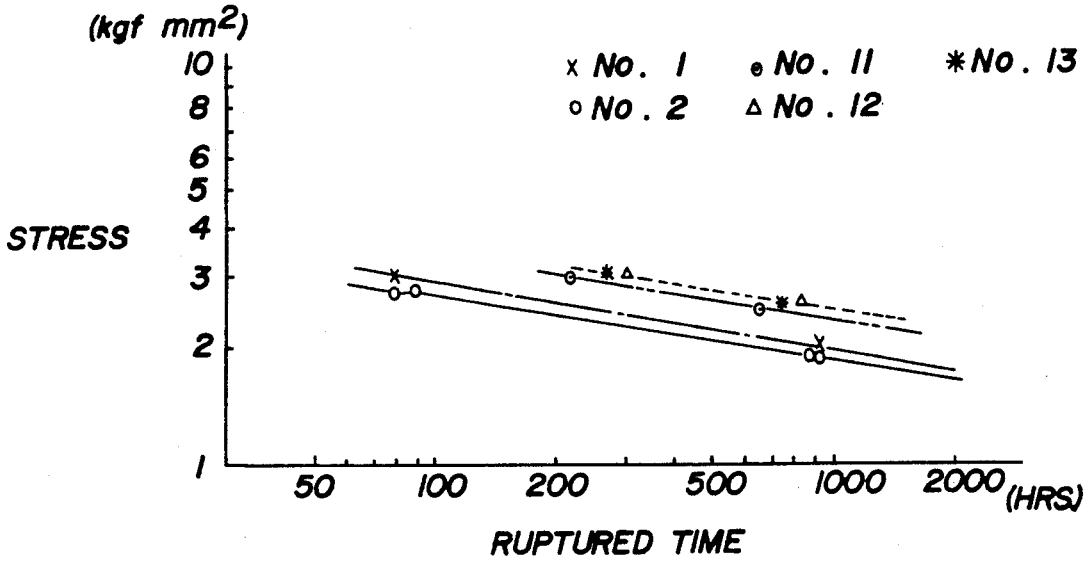
FIG. 3 is a graph showing the results of a creep rupture test.

FIG. 3 shows the results of the creep rupture test.

Figure 4:
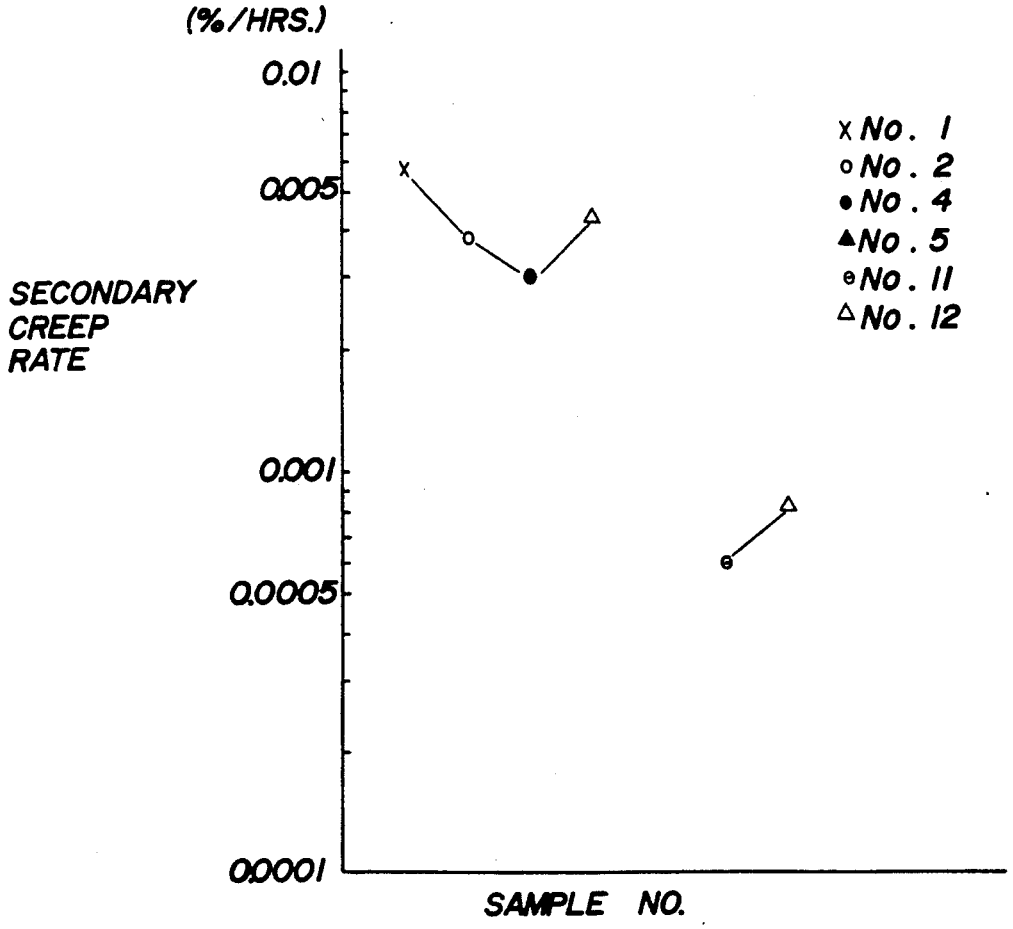
FIG. 4 is a graph showing the results of a creep elongation test.

The creep elongation test was conducted at a temperature of 1100° C. under a load of 1.5 kgf/mm$^2$. FIG. 4 shows the results.

Figure 5:
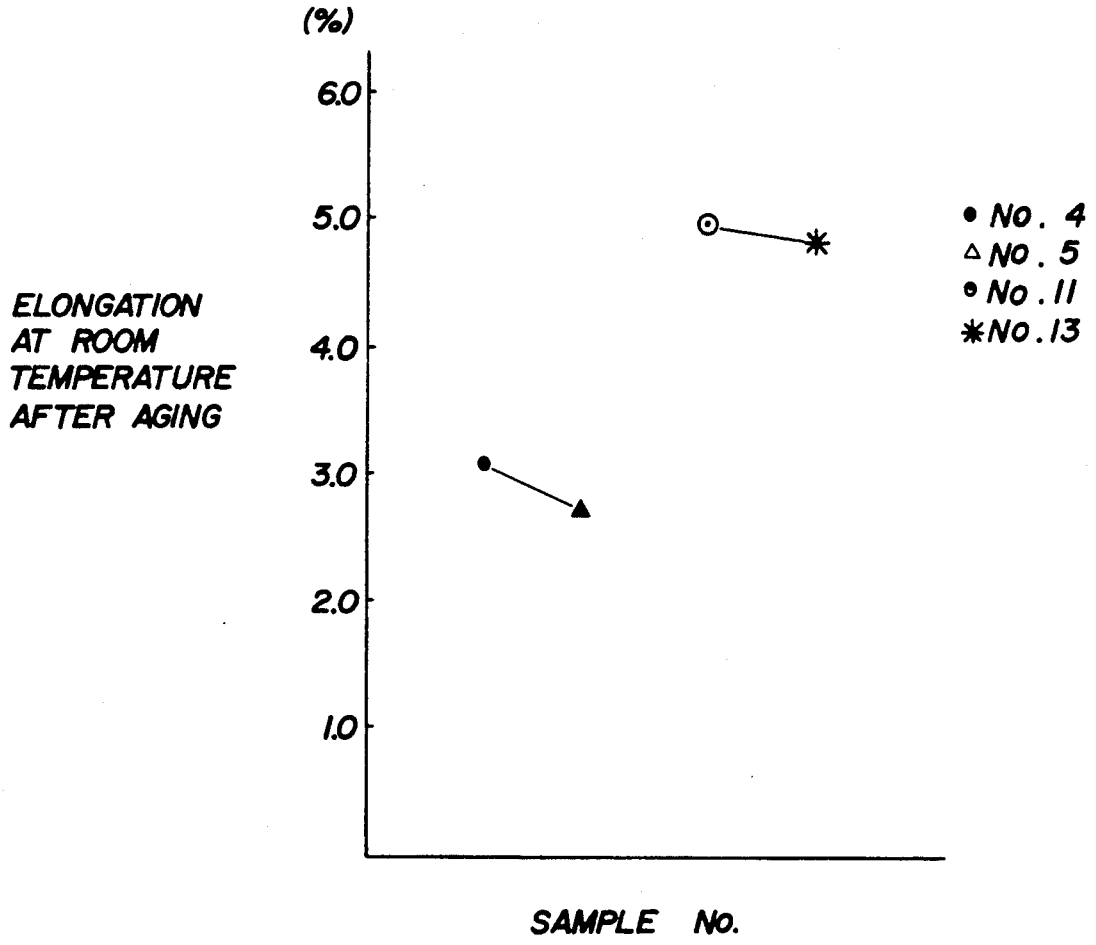
FIG. 5 is a graph showing the results of a tensile elongation test conducted at room temperature after aging.

For the tensile test at room temperature, the test piece was aged at 1100° C. for 1000 hours and thereafter tested for tensile elongation at room temperature. FIG. 5 shows the results.

FIG. 1 shows that the alloys of the invention are at least about 50% less in the increase in the amount of carbon than samples No. 1 to No. 3 which are conventional alloys.

FIG. 3 reveals that the alloys of the invention are about 20% higher in creep rupture strength than conventional alloy samples No. 1 and No. 2. This is attributable to the cooperative acttion of Ti and N.

FIG. 4 demonstrates that the alloys of the invention are greatly improved over conventional alloy samples No. 1, No. 2, No. 4 and No. 5 in secondary creep rate, i.e., creep resistance.

FIG. 5 reveals that the alloys of the invention are greater than conventional alloy samples No. 4 and No. 5 in elongation at room temperature after aging at 1100° C. for 1000 hours. The elongation, if small, entails inferior weldability after use. Thus, the alloys of the invention are superior to the conventional alloys in weldability after use.

The improvements achieved in the secondary creep rate and elongation at room temperature are thought attributable to improved quantitative balance between Cr and Ti and/or Zr.

These results indicate that the alloys of the present invention are excellent not only in carburization resistance and creep strength but also in creep deformation resistance and in ductility after aging.

Accordingly the alloy of the present invention is well suited as a material for cracking tubes and reformer tubes for use in the petrochemical and chemical industries.

What is claimed is:

1. A heat-resistant alloy having high creep deformation resistance and high ductility after aging and consisting essentially of, in % by weight, 0.3–0.8% of C, 0.5–3% of Si, over 0% to not greater than 2% of Mn, at least 23% to less than 30% of Cr, 40–55% of Ni, 0.2–1.8% of Nb, over 0.08% to not greater than 0.2% of N, 0.01–0.5% of Ti and/or 0.01–0.5% of Zr, and the balance Fe and inevitable impurities.

2. A heat-resistant alloy as defined in claim 1 which contains at least one component selected from the group consisting of 0.02–0.6% of Al, 0.001–0.5% of Ca, up to 0.05% of B, up to 0.5% of Y and up to 0.5% of Hf.

TABLE 1

| Sample No. | Chemical Composition (Balance: Fe and impurities) (weight %) | | | | | | | | | | | | | | | | | | |
|---|---|---|---|---|---|---|---|---|---|---|---|---|---|---|---|---|---|---|---|
| | C | Si | Mn | P | S | Cr | Ni | Co | Nb | W | Mo | N | Ti | Zr | Al | Ca | B | Y | Hf |
| 1 | 0.46 | 1.60 | 0.91 | 0.015 | 0.015 | 25.56 | 34.09 | | 0.81 | | | 0.050 | | | | | | | |
| 2 | 0.45 | 1.66 | 0.44 | 0.012 | 0.013 | 24.62 | 34.91 | | 1.20 | 1.02 | 0.45 | 0.047 | | | | | | | |
| 3 | 0.41 | 1.28 | 0.75 | 0.011 | 0.012 | 25.08 | 35.29 | | 1.03 | 1.02 | 0.49 | 0.029 | 0.19 | | 0.20 | | | | |
| 4 | 0.49 | 1.92 | 1.05 | 0.007 | 0.006 | 35.70 | 46.03 | | 0.61 | 0.64 | | 0.032 | 0.10 | | 0.12 | | | | |
| 5 | 0.47 | 1.95 | 0.88 | 0.009 | 0.007 | 36.12 | 45.44 | | 1.13 | 1.24 | | 0.151 | 0.19 | | 0.26 | | | | |
| 11 | 0.52 | 1.78 | 1.13 | 0.007 | 0.007 | 26.52 | 46.08 | | 1.32 | | | 0.087 | | 0.12 | 0.15 | | | | |
| 12 | 0.56 | 1.89 | 1.02 | 0.006 | 0.010 | 28.22 | 44.97 | | 1.43 | | | 0.095 | 0.13 | | 0.14 | | | | |
| 13 | 0.53 | 1.95 | 0.97 | 0.005 | 0.008 | 26.13 | 51.50 | | 1.28 | | | 0.091 | 0.13 | 0.15 | 0.21 | | | | |
| 14 | 0.38 | 1.67 | 0.95 | 0.007 | 0.008 | 25.18 | 45.70 | | 1.18 | | | 0.138 | 0.12 | | | | | | |
| 15 | 0.41 | 1.79 | 0.88 | 0.010 | 0.009 | 25.70 | 46.03 | | 1.24 | | | 0.105 | 0.10 | | 0.30 | 0.011 | | | |
| 16 | 0.42 | 1.72 | 0.88 | 0.010 | 0.008 | 25.43 | 46.30 | | 1.30 | | | 0.114 | 0.09 | | 0.34 | | | 0.12 | |
| 17 | 0.42 | 1.76 | 0.91 | 0.009 | 0.006 | 25.60 | 46.17 | | 1.22 | | | 0.123 | 0.13 | | 0.29 | | | | 0.20 |
| 18 | 0.43 | 1.67 | 0.93 | 0.010 | 0.008 | 25.60 | 31.90 | 15.38 | 1.19 | | | 0.105 | | 0.14 | 0.33 | | 0.010 | | |

With reference to Table 1, samples No. 1 to No. 5 are conventional alloys, and samples No. 11 to No. 18 are alloys of the invention.

* * * * *